US005810259A

United States Patent [19]

Sinclair

[11] Patent Number: 5,810,259

[45] Date of Patent: Sep. 22, 1998

[54] FLUID SPRAY NOZZLE COMPRISING AN IMPELLER WITH MEANS TO SIMPLIFY REMOVAL AND REPLACEMENT OF SAID IMPELLER

[75] Inventor: Bryan Sinclair, Palm Springs, Calif.

[73] Assignee: Environmental Engineering Concepts, Inc., Palm Springs, Calif.

[21] Appl. No.: 651,252

[22] Filed: May 23, 1996

[51] Int. Cl.[6] ..... B05B 1/34

[52] U.S. Cl. ..... 239/383; 239/487; 239/590

[58] Field of Search ..... 239/380–383, 239/487–489, 589, 590

[56] References Cited

U.S. PATENT DOCUMENTS

| | | | |
|---|---|---|---|
| 920,818 | 5/1909 | Breckenridge | 239/487 X |
| 1,688,585 | 10/1928 | Lalor | 239/488 X |
| 1,860,347 | 5/1932 | Crowe | 239/383 X |
| 2,639,941 | 5/1953 | Glynn | 239/488 X |
| 2,767,024 | 10/1956 | Swan | 239/383 |
| 3,598,317 | 8/1971 | Roberts | 239/489 X |
| 4,291,835 | 9/1981 | Kaufman | 239/383 X |
| 4,721,250 | 1/1988 | Kennedy et al. | 239/383 |

FOREIGN PATENT DOCUMENTS

| | | | |
|---|---|---|---|
| 1257855 | 2/1961 | France | 239/488 |
| 1384074 | 11/1964 | France | 239/488 |
| 377340 | 12/1939 | Italy | 239/489 |
| 825172 | 5/1981 | U.S.S.R. | 239/383 |

*Primary Examiner*—Lesley D. Morris
*Attorney, Agent, or Firm*—I. Louis Wolk

[57] ABSTRACT

A liquid atomizing nozzle is provided which is designed to receive various types of impellers in a chamber just preceding an orifice for the purpose of fracturing the liquid such as water to thereby facilitate the generation of fine fogs or sprays. The interchange of impellers and cleaning of nozzle and impeller chamber is simplified by the provision of a separate detachable inlet member to the nozzle which is designed to also retain the impeller in its chamber and to supply a jet stream of liquid thereto. The inlet member is in the form of a separate connector provided with an entry segment of greater diameter then a narrower exit segment connectable to the impeller chamber in a manner which encloses the chamber and retains the position of the impeller.

9 Claims, 1 Drawing Sheet

FLUID SPRAY NOZZLE COMPRISING AN IMPELLER WITH MEANS TO SIMPLIFY REMOVAL AND REPLACEMENT OF SAID IMPELLER

BACKGROUND

The present invention relates to an improved form of liquid atomizing nozzle designed to produce fine fogs, mists and sprays.

The use of nozzles of varying types to disperse water in finely divided form to produce such fogs, mists and sprays, to effect temperature and humidity control for agricultural and similar purposes or for effecting temperature control in residential or commercial environments, etc., is well known in the prior art.

Such prior art includes U.S. Pat. Nos. 2,540,663, 3,788,542, 4,721,250 and others, all of which describe various types of nozzles tried for similar purposes.

This invention is a modification and improvement of a nozzle structure over that described in U.S. Pat. No. 4,721,250, in which the nozzle is formed by providing a housing with an orifice which is connected to a water supply. A chamber is provided within the housing communicating with the orifice to accommodate an impeller designed to rotate in response to the water flow with resulting fracture of the water stream prior to emergence from the nozzle. While this prior nozzle design has been found to be effective for most purposes it does not provide a suitable degree of flexibility in permitting ready access to the impeller chamber to permit impeller replacement.

SUMMARY OF THE INVENTION

In accordance with the present invention, applicant has discovered that in order to obtain desired control over the nature and type of spray, mist or fog which a selected nozzle orifice can generate, it may be necessary to use impellers of varying structure or surface configurations. This requires that the nozzle assembly be so constructed that the nozzle structure be so designed that insertion and removal of a selected type of impeller may be carried out in a simple manner. This is particularly the case where a multiplicity of nozzles have been or will be installed over a substantial area as is generally required for cooling or agricultural misting or fogging. The new nozzle structure would then permit insertion or substitution of impellers of a suitable type as required without time consuming dismantling. In addition, it has been found that from time to time, cleaning of the impeller chamber is required to remove scale or other deposited material which may clog the orifice.

As described herein, impellers of differing designs can result in variation in the type and degree of fracture of the water stream as it enters the orifice for discharge as a fine spray or fog and thereby enable the nozzle to generate fogs or mists of varying types.

In order to accomplish these objectives applicant has designed a unitary nozzle formed with an orifice of the desired diameter with a chamber in front of the orifice of suitable dimensions to accommodate various types of impellers. This housing is formed with a threaded inlet and is connected to a sepaparate interconnecting member for connection to a water supply which is itself readily attachable and detachable from the nozzle and the water supply means. The nozzle and its components are usually formed of high quality steel preferably corrosion resistant or other suitable alloys. Stainless steel is often used.

DETAILED DESCRIPTION

Figures 1, 2, 3, 4, 5, 6, 7, 8, 9:
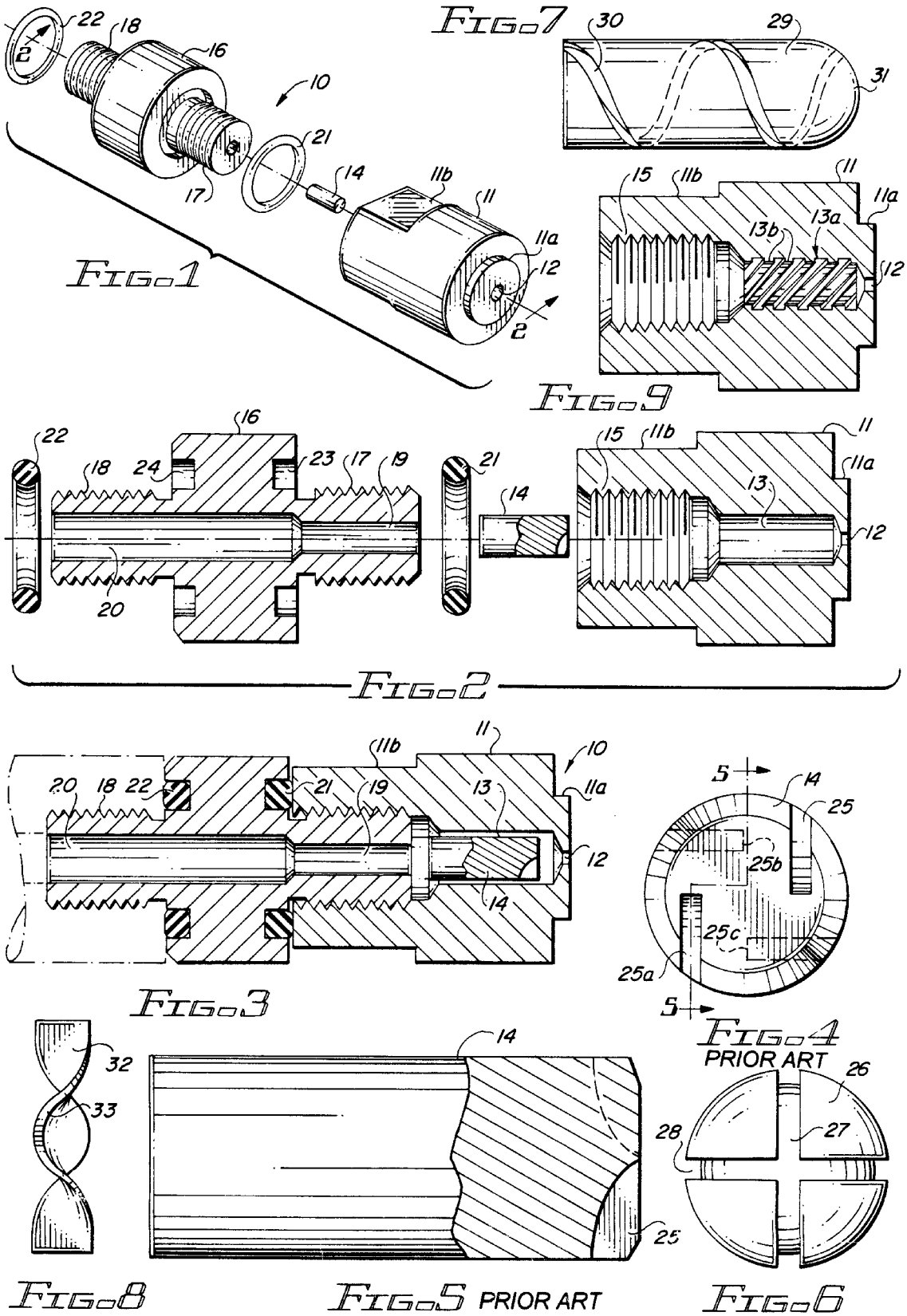
FIG. 4 PRIOR ART
FIG. 5 PRIOR ART
FIG. 1 is an expanded view in elevation of the nozzle and its interconnecting member.
FIG. 2 is a view in cross section through FIG. 1 along line 2—2.
FIG. 3 is a view in cross section corresponding to FIG. 2 as assembled.
FIG. 4 is an end view of the impeller shown in FIG. 5, shown along lines 5—5.
FIG. 5 is a view partly in cross section of a cylindrical impeller.
FIG. 6 is a view in elevation of a form of a spherical impeller.
FIG. 7 is a view in elevation of another form of cylindrical impeller.
FIG. 8 is a view in elevation of another form of impeller.
FIG. 9 is a view in cross section of a segment of an alternate form of impeller chamber.

As shown in FIGS. 1 and 3 the nozzle assembly 10 is composed of nozzle unit 11, shown with orifice 12 and which may be formed with a slight forward extension 11*a*, which, as described in U.S. Pat. No. 4,721,250, can serve to minimize the formation of residual droplets and resulting deposition of minerals which may clog the orifice from the exterior. As shown in FIGS. 2 and 3 nozzle housing 11 is formed with a cylindrical chamber 13 for the reception of an impeller 14 as shown in FIGS. 1–5 or one of the other impellers as shown in FIGS. 6–8 as described further below.

As shown, the nozzle unit, per se, is provided with opposed flat areas 11*b* for engagement with mounting means but may also be cylindrical or any other desired shape which can be mounted in any desired manner interconnected to a water supply.

Nozzle housing 11 is drilled with a threaded female inlet, area 15, to provide fastening means to permit connection to connector member 16 by means of a fitting male threaded extension 17. If desired, the configuration of 15 and 17 may be reversed. The nozzle housing is easily attached to an intermediate connector member 16 having threaded extensions 17 and 18 and fluid channels 19 and 20. Upon assembly as shown in FIG. 3, impeller 14 is inserted into chamber 13 after which threaded extension 17 is screwed into corresponding inlet 15 of the nozzle with gasket or O-ring 21 retained in socket 23 to provide a tight seal.

Similarly, connector member 16 is provided with a socket area 24 to reserve a gasket or O-ring 22 permitting it to be attached to a water supply tube having a threaded end to engage threaded member 18 for a tight seal.

As shown in FIGS. 2 and 3, connector member 16 is provided with a fluid inlet channel 20 which is of greater diameter than outlet channel 19 which is designed to have a diameter less than the diameter of impeller chamber 13 and also less than the diameter of impeller 14. As a result, threaded end extension 17 of connector member 16 serves to enclose chamber 13 sufficiently to retain the impeller. At the same time the inner diameter of chamber 13 is designed to provide a slight gap between its wall and the impeller to permit rotation and horizontal reciprocal movement inasmuch as the length of chamber 13 is designed to be longer than the impeller. Thus, as the water flows through inlet, channel 20 and thence through restricted channel 19 under pressure, it impinges upon impeller 14, causing rotational and resultant fracture of the water stream as it enters orifice 12.

As shown in FIGS. 2 and 3, the front channel 20 has a greater diameter than channel 19 and serves to feed the high pressure water supply to the narrower channel, which in turn jets the water into chamber 13 and then impinges on the impeller whose rotation serves to fracture the water as it responds to the water flow.

The dimensions of the nozzle unit are relatively small since the housing need only accommodate the orifice, which may have a diameter in the range of about 0.008 inches to 0.035 inches. In most cases the orifice diameter will be selected on the basis of the particle size desired.

The chamber which houses the impeller and the impeller itself will also be relatively small. The chamber itself may vary in diameter and length depending on the size of impeller to be used and will be slightly longer than the length of the impeller with a circumferential clearance to allow freedom of rotation and lateral movement. These factors also depend on the type of spray or fog to be generated. The impeller itself may have a diameter in the range of 0.075–0.150 inches, with one particular model having a diameter of 0.092 in. The length may vary from 0.150–0.300 in. The dimensions of chamber and impeller are selected to provide for a clearance between the impeller and chamber of at least about 0.002 in.

The water pressure as fed to the nozzle may be in the range of about 400–3000 psi as required to generate the type of spray desired. With other fluids, the pressure orifice and other dimensions may be varied.

In FIGS. 4 and 5 a cylindrical impeller of the type described in U.S. Pat. No. 4,721,250 is illustrated. This is a small solid steel cylinder 14, in which a pair of slots 25 and 25*a* have been formed at the front end. Fluid flow longitudinally thereof causes it to rotate due to the opposed position of the slots and also to flutter or move back and forth, thus disrupting or fracturing the water stream just prior to entry into, the orifice. These slots are formed parallel and opposite to each other and extend inward across the front end spaced from the center. These slots are in the form of curved incisions extending from the outer surface as shown. Also, instead of one pair, of such slots, an additional pair may be formed as shown by dotted lines 25*b* and 25*c,* in the corresponding opposite position.

Other forms of impellers which disrupt water flow in various ways are shown in FIGS. 6, 7 and 8.

In FIG. 6 it shows an impeller in the form of a solid sphere 26, preferably of stainless steel which is provided with a pair of circumferential slots 27, 28, at right angles. The ridges provided by these slots cause rotation as well as back and forth lateral movement. The depth of these slots can vary depending upon the effect desired. The diameter will depend upon the diameter and length of the chamber with the appropriate clearance.

FIG. 7 shows an impeller in the form of cylinder 29, with its front end 31 contoured as shown, resulting in a bullet shape. To ensure appropriate rotation and movement, the surface is formed with a helical longitudinal slot 30. The dimensions will also confirm to the chamber with clearance.

FIG. 8 shows still another type of impeller which is a segment of a flat steel strip 32 which is formed with a helical twist 33. The resulting helical conformation results in rotational and lateral movement under fluid flow in the direction of the orifice. The length and width of the strip are such that free rotation is permitted in response to water flow, with similar clearance.

FIG. 9 shows a modification of the nozzle structure in which the interior walls of chamber 13*a* are provided with rifling grooves 13*b*. This rifling provides a helical path for water flow toward the orifice which in turn further activates whichever type of impeller is used. This has been found to result in further improvement in water fracture which can facilitate or modify fog production.

As described above, in the operation of the nozzle, water or other fluid is introduced into connector 16 through inlet 18 at the desired pressure, passes through channel 20 which has a diameter conforming to the supply means and thence through channel 19 having a smaller diameter sufficient to retain impeller 14 and to supply chamber 13 and the impeller with a focused high pressure stream which activates the impeller and fractures the water stream before it enters orifice 12. This results in a fine dispersion having particles much smaller in diameter than that of the orifice.

I claim:

1. A nozzle for atomizing a liquid which comprises a housing, an orifice outlet in said housing, a cylindrical chamber within said housing in alignment with said orifice outlet, a fluid inlet in alignment with said chamber, an impeller positioned within said chamber, the diameter and length of said chamber being dimensioned to slightly exceed the length and width of said impeller whereby said impeller is forced into movement by the flow of liquid through said inlet, and a separate detachable connector with a fluid passage extending therethrough at one end connectable to said inlet in alignment with said chamber and at the other end to a liquid supply means, said passage being divided into an entry segment and a narrower exit segment, wherein said entry segment of said fluid passage has a greater diameter than the exit segment thereof and a diameter of said exit segment is smaller than diameters of the impeller and chamber such that the impeller is completely retained in the chamber while a jet stream is introduced, whereby replacement of said impeller and cleaning of the chamber is easily carried out by detachment of said connector for removal and reinsertion of said impeller into said chamber.

2. In a spray nozzle according to claim 1 wherein said connector comprises threaded ends enclosing said fluid passage one end being adapted to be screwed into corresponding threads in said housing and the other end being adapted to be screwed into corresponding threads in said water supply means.

3. A nozzle according to claim 1, wherein said chamber is provided with rifling grooves adapted to direct fluid in a helical path around said impeller and toward said orifice outlet whereby improves fracture of fluid prior to entry into said orifice.

4. A nozzle according to claim 1, wherein said impeller is in the form of a cylinder, the front end of which is provided with a plurality of slots to facilitate rotation.

5. A nozzle according to claim 1, wherein said impeller is in the form of a cylindrical body with a rounded contoured front end and is provided with a helical groove extending from front to rear thereof.

6. A nozzle according to claim 1, wherein the impeller is in the form of a cylinder having a pair of circumferential slots formed thereon extending at right angles to each other.

7. A nozzle according to claim 1, wherein the impeller is in the form of a flat strip which is twisted to provide a helical surface.

8. A nozzle according to claim 4, wherein said slots are as a pair each of which extends from opposite sides of the outer surface of the impeller across the front end thereof, parallel to each other and spaced from the center.

9. A nozzle according to claim 4, wherein said slots are positioned as 2 pairs in which said slots of each pair are parallel to each other and extend inwardly spaced from the center.

* * * * *